United States Patent [19]

Mukai

[11] Patent Number: 4,936,561

[45] Date of Patent: Jun. 26, 1990

[54] APPARATUS FOR ADJUSTING THE DIAMETER OF FOLDING DRUM IN A ROTARY PRESS

[75] Inventor: Yuji Mukai, Hiroshima, Japan

[73] Assignee: Mitsubishi Jukogyo Kabushiki Kaisha, Tokyo, Japan

[21] Appl. No.: 210,015

[22] Filed: Jun. 22, 1988

[30] Foreign Application Priority Data

Jun. 24, 1987 [JP] Japan ..... 62-155557

[51] Int. Cl.[5] ..... B42C 1/00

[52] U.S. Cl. ..... 270/45; 270/47; 493/476

[58] Field of Search ..... 270/45, 46, 47, 48, 270/49, 50, 20.1, 21.1; 493/475, 476, 478, 479, 424–431

[56] References Cited

U.S. PATENT DOCUMENTS 2,555,267 5/1951 Crafts ..... 270/47
3,477,709 11/1969 Neal et al. .
4,805,502 2/1989 Ishigure ..... 493/475

FOREIGN PATENT DOCUMENTS 168632 9/1921 United Kingdom ..... 493/475
217009 6/1924 United Kingdom ..... 493/431

*Primary Examiner*—Robert E. Garrett
*Assistant Examiner*—Therese M. Newholm
*Attorney, Agent, or Firm*—Wenderoth, Lind & Ponack

[57] ABSTRACT

An apparatus for adjusting a diameter of a folding drum in a rotary press includes essentially, bands, slide bases, screw rods, sun gears, a differential device and mechanism for operating the differential device. The bases, formed with internal threads, support the bands. The screw rods, fitted in the internal threads, have pinion gears. The sun gears are concentric with the folding drum, mesh with the pinion gears and are rotatable with respect to the folding drum. The operating mechanism changes phases of the sun gears with respect to the folding drum. Then, the screw rods rotate, and the bands expand and contract, thus adjusting the diameter of the folding drum.

11 Claims, 8 Drawing Sheets

APPARATUS FOR ADJUSTING THE DIAMETER OF FOLDING DRUM IN A ROTARY PRESS

BACKGROUND OF THE INVENTION

1. Field of the Invention

The present invention relates to an apparatus for adjusting a diameter of a folding drum the folding drum being capable of stably discharging sheets of paper during the operation of a folding machine in a rotary press.

2. Description of the Prior Art

A conventional technique will be explained with reference to FIGS. 4 through 6.

The operation of a folding machine is typically classified into single-folding and double-folding. The single-folding process is performed in the following manner. Sheets of printed paper which have been wound up are cut to a predetermined length by a saw blade 02*a* of a saw drum 02 in cooperation with a needle 03*a* of a needle device 03 of a folding drum 01. Subsequently the sheets of paper are creased by a folding blade 04 and are folded sheet by sheet by a pair of folding rollers 05. The paper is then discharged. On the other hand, the double-folding process is effected in such a way that the cut paper is made to pass temporarily by, halting the operation, a subsequent printed paper so folded so as to be superposed on the previous paper one, and the paper then being discharged.

A single unit of a folding machine serves to perform both the single-folding process and the double-folding process. The folding machine is constructed to adapt to a wide variety of modes, i.e., variations in the number of pages and the quality of paper. More specifically, as illustrated in FIG. 5, bands 06 are disposed respectively at three positions on the outer periphery of the folding drum 01. One end of each individual band 06 is so fixed as to be finely adjustable, and the other end thereof is movable in the tangential direction of the folding drum.

The band 06 is pushed from a position depicted with a solid line in FIG. 5 to a position shown by a dotted line on the the outer periphery of the folding drum 01, whereby the band 06 is swollen in the position 06*a* indicated by the dotted line. The overall diameter of the folding drum is adjusted on the basis of the quantity of swelling at the three positions on the outer periphery of the folding drum.

Mechanisms for adjusting the swelling quantity of the bands 06 at the three positions on the outer periphery will now be described. The adjusting mechanisms provided at the three positions have the same features, and hence only one of them will be explained.

The arrangement begins with a step of embedding one end of the band in the outer peripheral portion of the folding drum. One end thereof is connected with a pin 09*a* to a slide plate 07 slidable in the tangential direction for 0-point-setting by use of an adjustment screw 09*c*. The other end of the band is connected with a pin 09*b* to a slide plate 08 embedded in a position relative to the slide plate 07 on the outer periphery of the folding drum and slidable in the tangential direction. A rotatable cam follower 010 is fastened to the lower surface of the slide plate 08. The cam follower 010 is inserted in an oblique groove 012 chased in a portion of the upper surface of slide base 011 axially slidable by dint of a rotation screw rod 013. Note that the bands 06 are allocated to a plurality of positions in the longitudinal (axial) direction, and the plurality of slide plates 07 and 08 are set to be slidable with the help of guide plates 023*a* and 023*b* only in the direction axially orthogonal to the folding drum 01.

An operating end of the slide base 011 is formed with an internal thread. A screw rod 013, the opposite end of which is provided with a gear 014, is fitted into the internal thread. The screw rods 013 are axially rotatably supported on bearings 01*b* provided at the three positions on the outer periphery of the folding drum body 01. The gears 014 provided at the axial ends of the screw rods 013 mesh with gears 015 rotatably mounted on studs 015*a* embedded in the outer periphery of the folding drum body 01. Sprockets 016, integral with the gears 015, are linked through endless chains 021 to main driving sprockets 017 disposed at predetermined positions on the outer periphery of the folding drum. The endless chains 021 are, as depicted in FIG. 6(*a*), arranged so that their tensions are adjusted by idler sprockets 022 provided at predetermined positions on the outer periphery of the folding drum body 01.

The main driving sprocket 017 is fixed to an axial end of a wheel shaft 019 of a worm gear box 018 installed on the outer peripheral portion of the folding drum. An unillustrated handle is inserted from outside of the folding drum in the direction orthogonal to the drum into a four-side chamfering portion 020*a* provided at the axial end of a worm shaft 020 disposed orthogonally to the wheel shaft 019. The worm shaft 020 is manually rotated.

In this arrangement, the adjustment of the diameter of the folding drum involves the steps of stopping the machine, inserting the handle into the worm shaft end portion 020*a* of the worm gear box 018 provided on the outer periphey of the folding drum 01 and manually rotating the worm shaft 020. As a result, the rotation is conveyed to the gear 014 fixed to the axial end of the screw rod 013 through the sprockets 016 formed with the gears 015 which are provided at the three positions on the outer periphery of the folding drum by means of the endless chains 021, with the sprockets 017 serving as driving sources. The rotation of the gear 014 permits the slide base 011 to slide in the longitudinal direction of the folding drum through the screw rod 013, with the result that the slide plates 08 allocated to the respective positions of the folding drum direction simultaneously slide in the tangential direction through the cam followers 010. Because of the sliding action of the slide plates, the plurality of bands 06 connected through the pins 09*b* to the slide plates 08 concurrently expand and contract in the tangential direction of the folding drum at the three predetermined positions on the outer periphery of the folding drum, wherein the band connecting pins 09*a* of the slide plates 07 serve as cardinal points. The expansion and contraction of the respective bands are effected en bloc by manually operating the worm shafts 020, and their swelling quantities $\beta$ are controlled, thus adjusting the diameter of the folding drum.

In recent years, there has increasingly been a market-demand for a folding machine capable of responding to a wide variety of modes, viz., variations in the number of pages or in paper quality during operation. There arise, however, the following problems inherent in the prior art folding machine. Every time the diameter of the folding drum is adjusted to meet such requirements, the adjustment operations have to be done during the stoppage of machine. This results in poor performance. Besides, it is impossible to adjust the diameter of the folding drum while observing conditions under which the sheets of paper are drawn in during the operation. Therefore, the market needs of automatization and presetting of the folding machine can not be attained.

SUMMARY OF THE INVENTION

It is a primary object of the present invention to eliminate the above-described problems and to provide an apparatus for adjusting a diameter of a folding drum in a rotary press which comprises a plurality of slide bases slidably disposed in predetermined positions on the outer periphery of the folding drum in the longitudinal direction thereof, and screw rods fitted in operating end portions of the slide bases, and pinion gears fixed to the screw rods. Sun gears, concentric with the folding drum, are meshed through intermediate gears with the pinion gears, the sun gears being so arranged that the sun gears, which are not fixed to a rotary shaft of the folding drum, make the same concentric rotation as that of the folding drum. A differential device is disposed in a driving system for the sun gears. An operating means operates the differential device from outside of the machine, the operating means serving to change the phases of the sun gears with respect to the folding drum.

In this construction, the sun gears, supported concentrically with the folding drum, are mannually or automatically operated from outside of the machine through the differential device, whereby the phases of the sun gears with respect to the folding drum are varied. Simultaneously, the screw rods screwed in the slide bases are forced to rotate both in the forward direction and in the reverse direction through the sun gears. The bands, which are arranged in a plurality of lines on the outer periphery of the folding drum and allocated to the plurality of portions in the individual lines, are made to concurrently expand and contract through the slide bases, the cam followers and the slide plates, thereby adjusting the diameter of the folding drum.

The foregoing and other objects, features and advantages of the invention will become more apparent on reading the following detailed description with reference to the accompanying drawings.

BRIEF DESCRIPTION OF THE DRAWINGS

FIG. 1(*b*) is a sectional view taken substantially along line A—A of FIG. 1(*a*);

FIG. 2(*b*) is a view fully illustrating a portion B of FIG. 2(*a*);

FIG. 3(*b*) is a sectional view taken substantially along line C—C of FIG. 3(*a*);

FIG. 4(*b*) is a view taken in the direction of arrows substantially along line D—D of FIG. 4(*a*); FIG. 4(*c*) is a side view of FIG. 4(*b*); FIG. 4(*d*) is a view taken in the direction of arrows substantially along line E—E of FIG. 4(*a*); FIG. 4(*e*) is a view taken in the direction of arrows substantially along line F—F of FIG. 4(*a*); FIG. 4(*f*) is a side view of FIG. 4(*e*);

FIG. 6(*b*) is a sectional view taken substantially along line G—G of FIG. 6(*a*).

DETAILED DESCRIPTION OF THE PREFERRED EMBODIMENT

Figure 5:
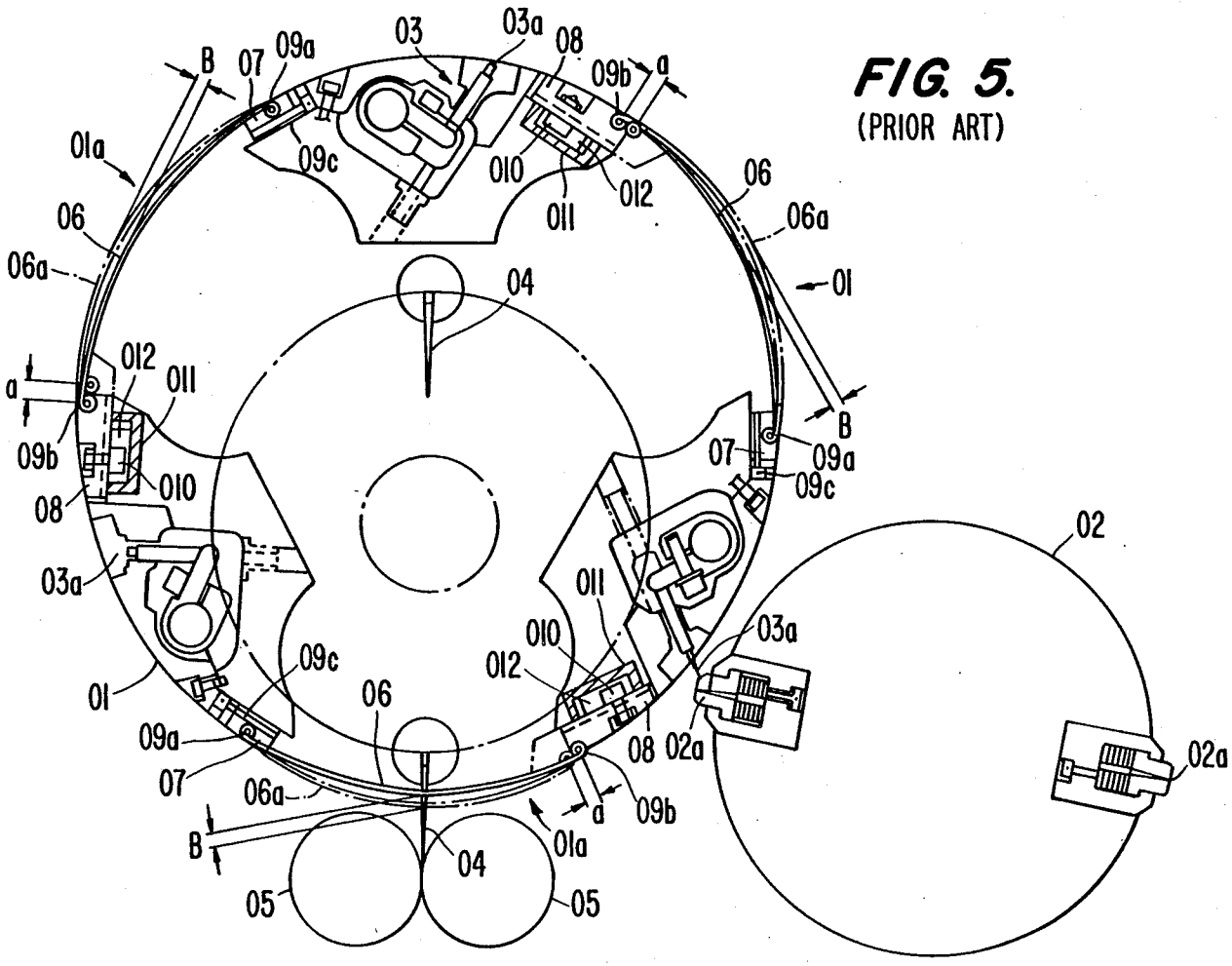
FIG. 5. (PRIOR ART)
FIG. 5 is an explanatory view showing an outline of a prior art apparatus.
Figure 6A:
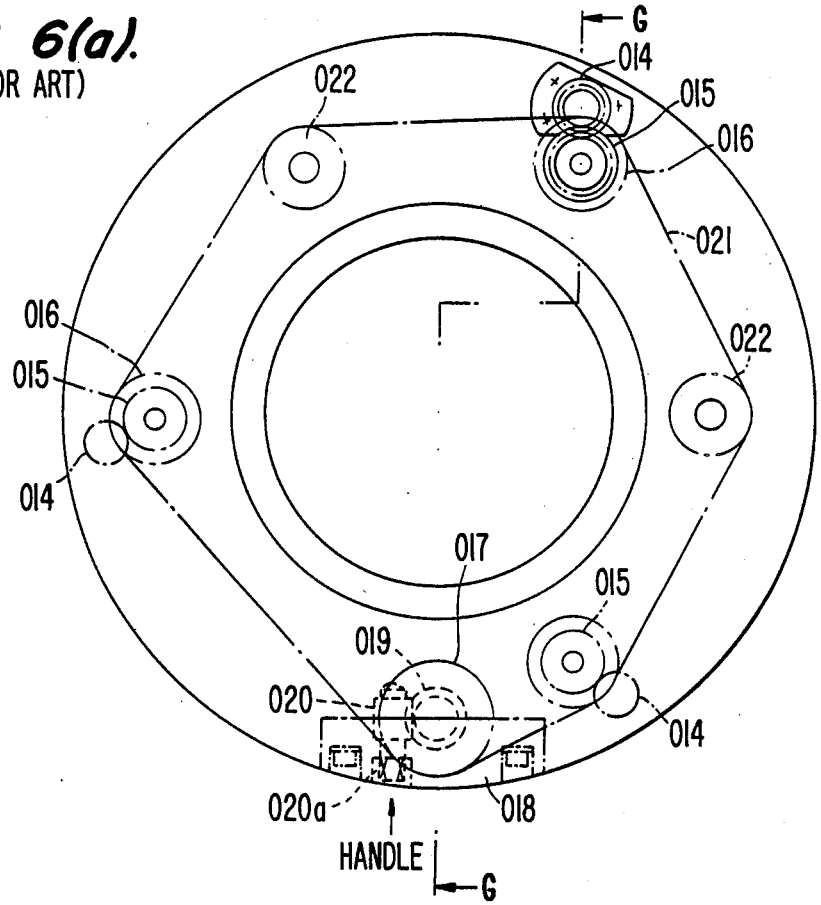
FIG. 6(a). (PRIOR ART)
FIG. 6(*a*) is a front elevation depicting a driving system of the mechanism for adjusting the diameter of the folding drum shown in FIG. 5.
Figure 6B:
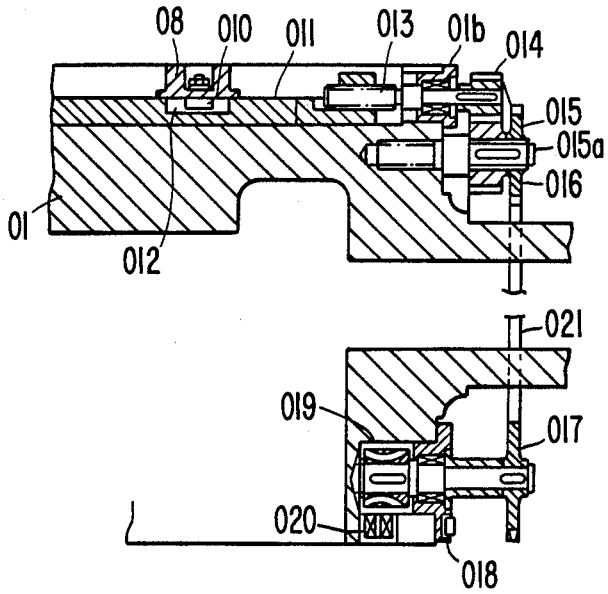
FIG. 6(b). (PRIOR ART)

As described in the prior art apparatus, slide bases slidable in the longitudinal direction of the drum are disposed in three predetermined positions on the outer periphery of the folding drum. Screw rods are fitted in operating ends of the slide bases; and pinion gears are fixed to the other ends of the screw rods. Oblique grooves are chased in a plurality of predetermined portions of the upper surfaces of the slide bases in the longitudinal direction. Cam followers, fixed to the lower surfaces of a plurality of slide plates, are rollable on the upper surface of the slide bases in the direction axially orthogonal to the folding drum and are fitted in the oblique grooves. Bands, both ends of which are fixed to the upper surfaces of the slide plates with pins, are, as depicted in FIGS. 4 and 5 showing the prior art apparatus, allocated by plural pieces to three positions in the longitudinal direction of the folding drum. The bands at one end are so fastened with the pins as to regulate the cardinal points. Positions of the cardinal points of the slide plates are determined by cardinal point adjusting bolts. With one ends serving as the cardinal points, the other ends of the bands are fastened to the slide plates with the pins. When the screw rods rotate both in the forward direction and in the reverse direction, the slide bases slide in the longitudinal direction, whereby the cam followers move along the oblique grooves formed in the slide bases. Thus, the slide plates fixedly provided with the cam followers slide in the tangential direction of the folding drum, and the bands fastened to the plates with the pins expand and contract in the tangential direction with their first ends serving as the cardinal points, thus adjusting the outside diameter of the folding drum.

Figure 2A:
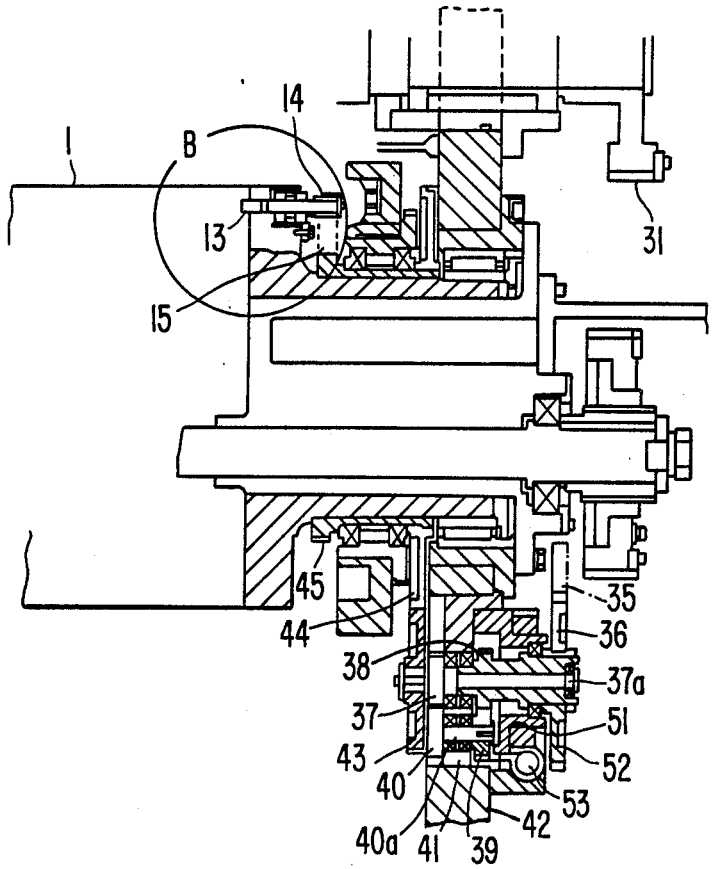
FIG. 2(*a*) is a sectional view depicting a driving system of FIG. 1(*a*)
Figure 3A:
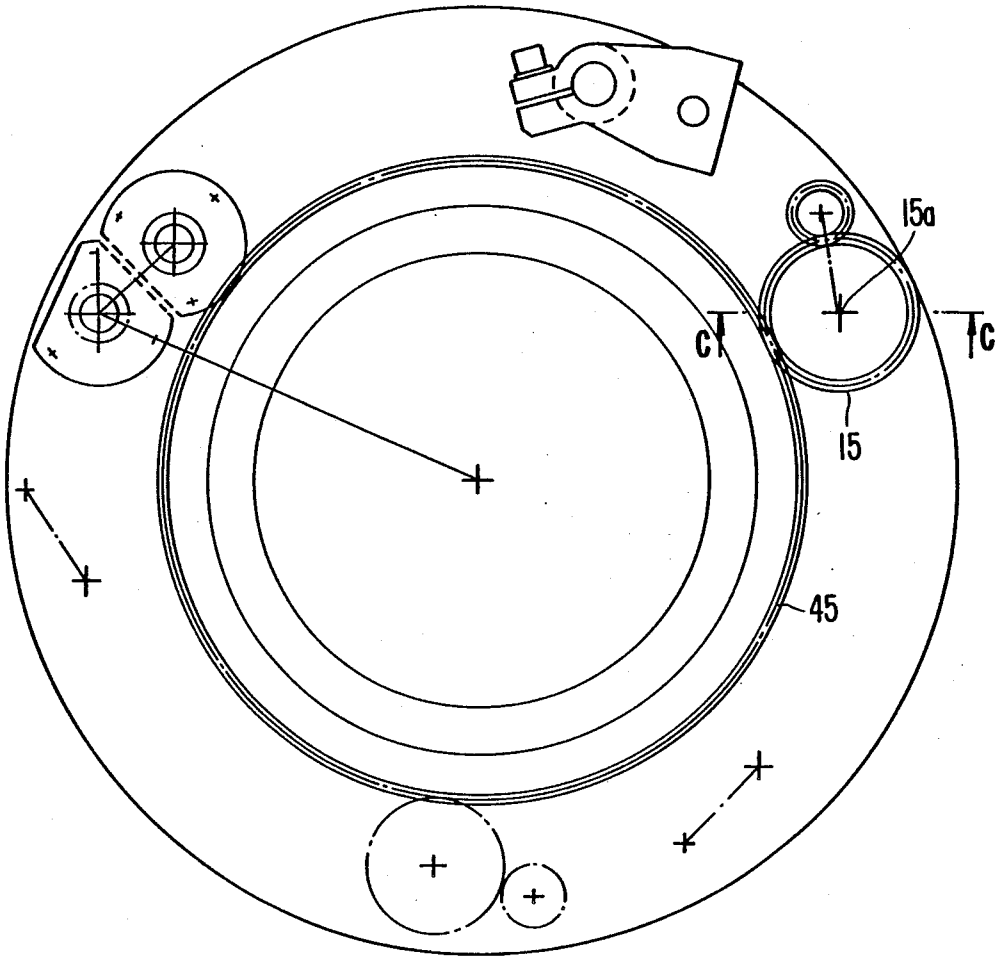
FIG. 3(*a*) is a view showing the placement of sun gears and intermediate gears of the folding drum.
Figure 2B:
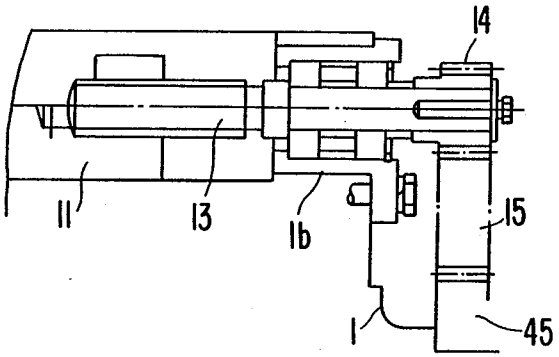
Figure 3B:
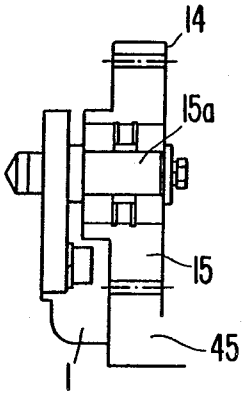
Figure 4A:
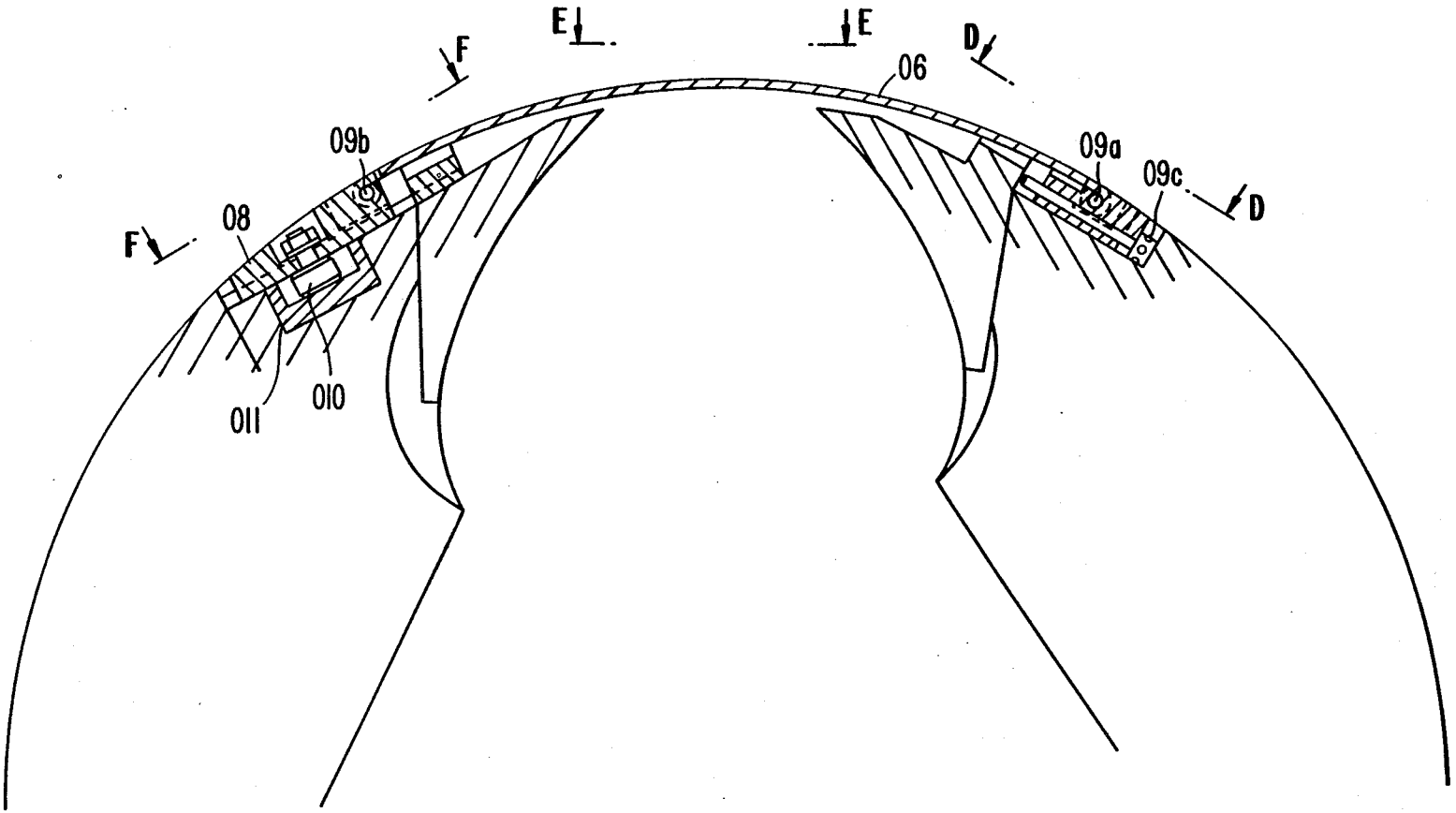
FIG. 4(a). (PRIOR ART)
FIG. 4(*a*) is a sectional view of bands intended to adjust the diameter of a folding drum in the prior art.
Figure 4B:
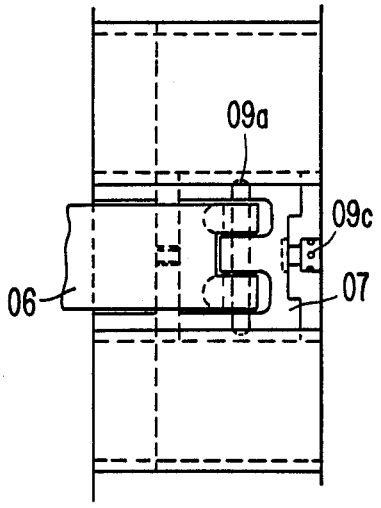
FIG. 4(b). (PRIOR ART)
Figure 4C:
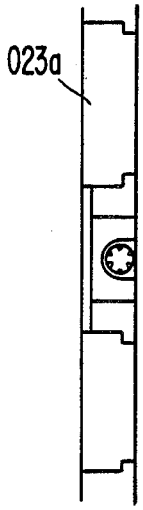
FIG. 4(c). (PRIOR ART)
Figure 4D:
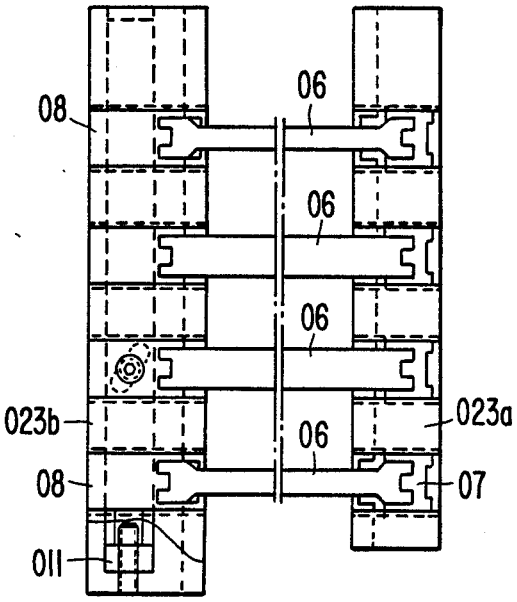
FIG. 4(d). (PRIOR ART)
Figure 4F:
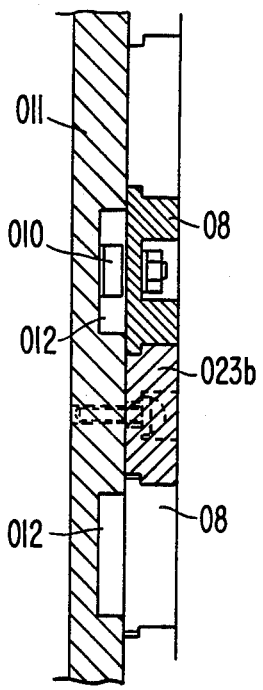
FIG. 4(f). (PRIOR ART)
Figure 4E:
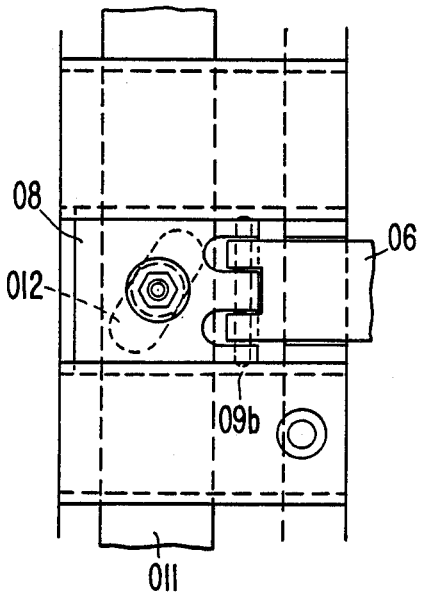
FIG. 4(e). (PRIOR ART)

The foregoing arrangement is completely the same as that in the above-described conventional apparatus, and hence the description based on a procedure of marking the components with their own numerals is omitted by referring to FIGS. 4 and 5. However, the components corresponding to those in FIGS. 1 to 3 are indicated by removing every 0 from the numerals of FIGS. 4 and 5.

The embodiment of the present invention will hereinafter be described. The description is focused mainly on a driving system for manually or automatically operating the screw rods, which are depicted in FIGS. 1 to 3, from outside of a folding machine.

A differential device involves a variety of modes. In this embodiment, there is exemplified a situation employing a planetary gear train. However, other differential devices available in the market will provide the same effects.

Figure 1A:
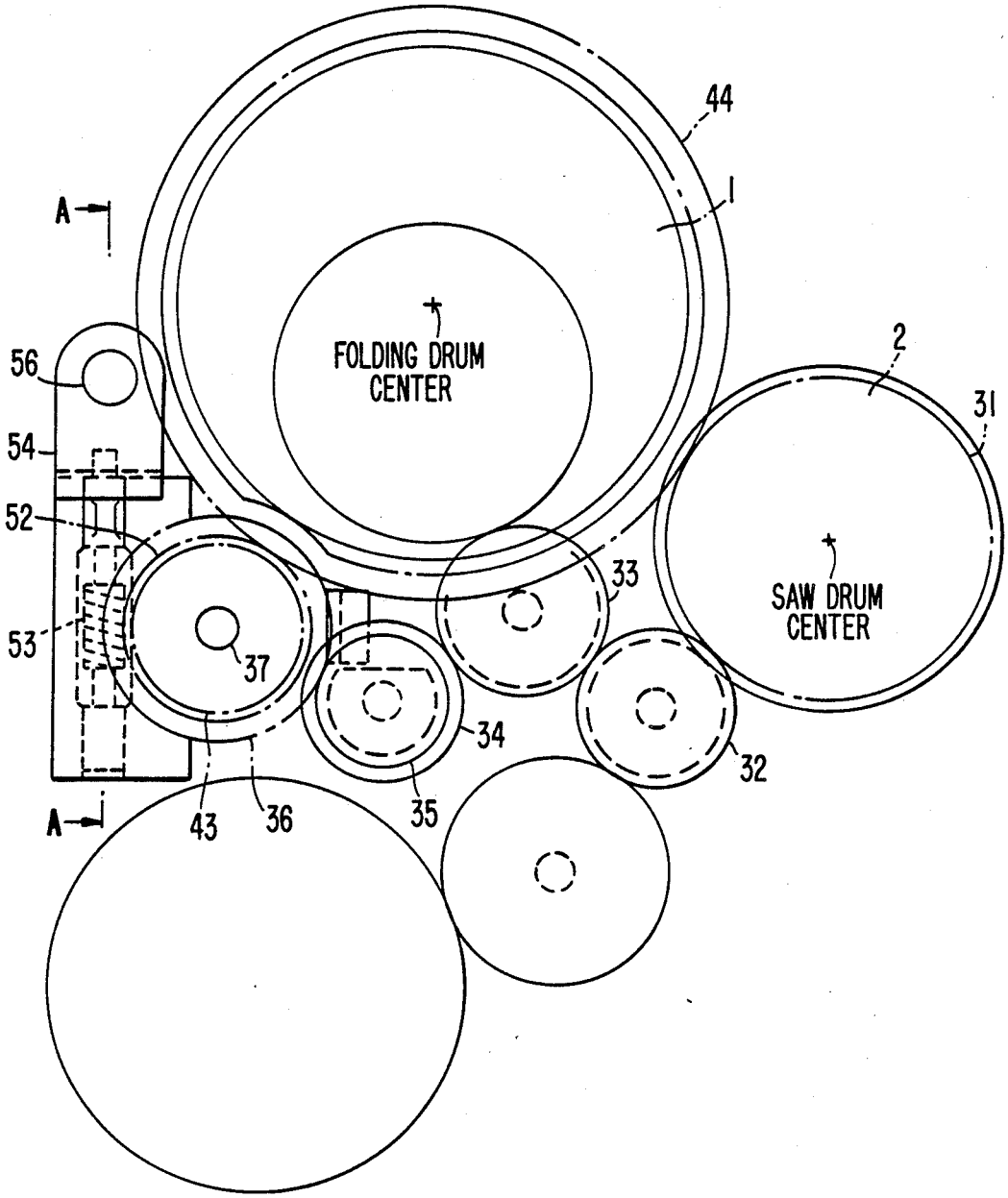
FIG. 1(*a*) is a view illustrating a placement of an entire apparatus for adjusting a diameter of a folding drum in a rotary press in an embodiment of the present invention.
Figure 1B:
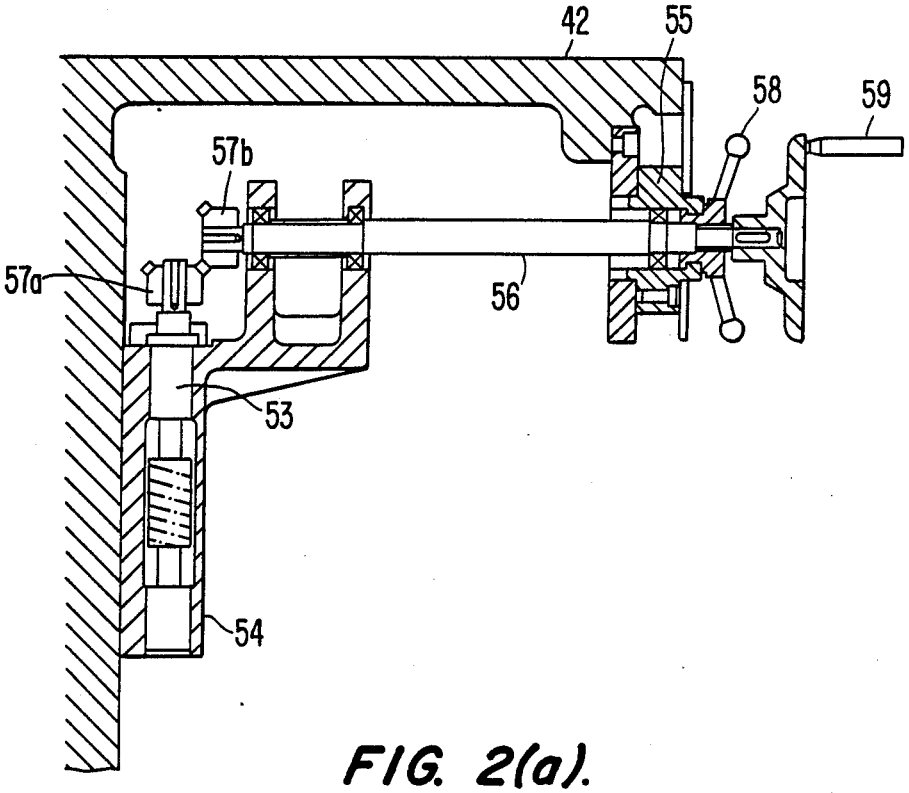

Referring first to FIG. 1(*a*), rotary forces are propagated from driving gears 31 of a saw drum 2 via intermediate gears 32, 33, 34 and 35 to a differential toothed wheel driving gear 36. Next, as illustrated in FIG. 2(*a*), the differential toothed wheel driving gear 36 linked to a differential toothed wheel 38 serves to convey driving forces to an intermediate toothed wheel 39. The intermediate toothed wheel 39 is linked through a key to a toothed wheel 40. The intermediate toothed wheel 39 is also supported on a differential toothed wheel receiver 41 in cooperation with a bearing so that the intermediate toothed wheel 39 rotates about a shaft 40*a* of the toothed wheel 40. The toothed wheel 40 engages with a toothed wheel 37 freely rotatable about an axis of the differential toothed wheel receiver 41; and sun gear driving toothed wheel 43 is fixed through a key to an axial end of the toothed wheel 37.

The sun gear driving toothed wheel 43 meshes with a sun gear 44. Sun gears 44 and 45 are arranged to be integral with each other. The sun gears 44 and 45 are not fixed to the shaft of the folding drum 1 but are so arranged that they make the same concentric rotations as those of the folding drum 1. The differential toothed wheel receiver 41 is disposed in the driving system. The sun gear 45, fixed to the end surface of the folding drum, meshes with a pinion gear 14 through an intermediate gear 15 rotatably attached via a bearing to one of studs 15*a* provided at the predetermined three positions on the outer periphery of the folding drum. The pinion gear 14 is fastened to the screw rod 13 with a key.

The constitution and function of the parts associated with the screw rods 13 is much the same with those in the prior art.

In the above-described arrangement, the rotary forces are imparted from the driving gear 31 of the saw drum via the intermediate gears 32, 33, 34 and 35, the differential toothed wheel driving gear 36, the intermediate toothed wheels 39 and 40, the toothed wheel 37 and the sun gear driving toothed wheel 43 to the sun gear 44. The rotary forces are further propagated from the sun gear 45 through the intermediate gear 15 to the pinion gear 14. According to the present apparatus, the following arrangement is made preparatory to the expansion and contraction of the bands distributively placed at the three positions in the longitudinal direction, for the purpose of adjusting the diameter of the folding drum. The differential toothed wheel receiver 41 is supported so as to be rotatable with respect to the operating frame 42, and a worm wheel bearing 51 is fixedly fastened to the differential toothed wheel receiver 41. A worm wheel 52 is fastened to the bearing 51. A worm shaft 53 engaging with the worm wheel 52 is, as illustrated in FIGS. 1(*a*) and 1(*b*), supported on a worm bearing 54 fixed to the frame 42. A bevel gear 57*a* attached to the end of the worm shaft engages with a bevel gear 57*b* provided at the tip of a worm driving shaft 56 provided orthogonally to the worm shaft 53. The worm driving shaft 56 is supported on the worm bearing 54 and on an operating bearing 55 of the worm driving shaft 56. A lock nut 58 and a handle 59 are provided at the tip of the worm driving shaft 56.

In the above-described constitution, the worm driving shaft 56 is rotated by turning the handle 59 from outside of the operating frame 42, whereby the intermediate toothed wheels 39 and 40 supported on the differential toothed wheel receiver 41 rotate about a differential toothed wheel shaft 37*a*. Then, the phases of the sun gears 44 and 45 with respect to the folding drum 1 vary. As the sun gear 45 rotates with respect to the folding drum 1, the gears 14 and 15 and the screw rods 13 also rotate. As a result, bands 06 (see FIGS. 4 and 5) provided at the three positions on the outer periphery of the folding drum expand and contract through slide bases 11 and slide plates 07. It is thus feasible to adjust a peripheral velocity of the folding drum accurately, safely and simply, to correspond to the number of pages and the feeding velocity thereof, while observing the condition from outside of the machine during the operation of the folding machine.

As discussed above, the present invention provides the following effects.

1. The diameter of the folding drum can be adjusted while observing a flow of paper during the operation of the folding drum of the folding machine in the rotary press.

2. An optimum value of the diameter of the folding drum, which stabilizes the flow of paper and the discharge thereof, can be obtained within a short period of time, thereby minimizing the loss of paper.

3. The operation from outside of the machine is practicable, and hence good operability can be obtained.

4. Since the handling operation can simply be changed to a button-operation by virtue of automatization based on the prior art, the automatization and presetting can readily be attained.

Although the illustrative embodiment of the present invention has been described in detail with reference to the accompanying drawings, it is to be understood that the invention is not limited to the precise embodiment. Various changes or modifications may be effected therein by one skilled in the art without departing from the scope or spirit of the invention.

What is claimed is:

1. An apparatus for adjusting the diameter of a folding drum in a rotary press, comprising:

a plurality of bands located on said folding drum, said bands being adjustable to expand and contract to vary the diameter of said folding drum;

a plurality of internally threaded slide bases slidably mounted on said folding drum, each said slide base engaging a said band to be able to adjust said band by sliding movement of said slide base;

a plurality of screw rods, one said screw rod threaded into the internal threads of each said slide base, and each said screw rod having a gear means connected thereto for rotating said screw rod;

sun gear means for engaging said gear means of said screw rods, said sun gear means disposed so as to be rotatable relative to and concentric with said folding drum;

drive means for driving said sun gear means so as to rotate in phase with said folding drum; and differential means connected to said drive means for varying the phase of said sun gear means relative to said folding drum such that said sun gear means rotates relative to said folding drum to drive and rotate said gear means of said screw rods, rotating said screw rods, sliding said slide bases, and adjusting said bands.

2. The apparatus as set forth in claim 1, wherein:

said bands are disposed at three positions about the periphery of said folding drum, each said band having an adjustable pin connection at one end thereof connecting said band to said folding drum and a said slide base at the other end thereof.

3. The apparatus as set forth in claim 2, wherein:

each said band has a slide plate pin connected thereto by a pin at said other end;

each said slide plate has a rotatable cam follower fastened to a lower surface thereof; and each said slide base has an oblique groove therein, wherein each said rotatable cam follower is inserted in a said oblique groove of a slide base, whereby movement of said slide base by a respective said screw rod causes a respective said oblique groove to cam said cam follower and move said slide plate to adjust a respective said band.

4. The apparatus as set forth in claim 1, wherein:

said gear means of each said screw rod comprises a pinion gear connected to said respective screw rod and an intermediate gear meshed with said pinion gear and engaged with said sun gear means.

5. The apparatus as set forth in claim 4, wherein said sun gear means comprises:

a first gear engaging said drive means; and a second gear integral and concentric with said first gear and meshed with each said intermediate gear of said gear means of said screw rods.

6. The apparatus as set forth in claim 1, wherein said sun gear means comprises:

a first gear engaging said drive means; and a second gear integral and concentric with said first gear and engaged with each said gear means of said screw rod.

7. The apparatus as set forth in claim 6, wherein:

said drive means comprises a gear train having a toothed wheel meshed with said first gear of said sun gear means.

8. The apparatus as set forth in claim 7, wherein:

said gear train further has an intermediate toothed wheel supported by a bearing;

said differential means comprises a differential toothed wheel receiver supporting said bearing and rotatable about the axis of said toothed wheel meshed with said first gear of said sun gear means, said differential means further comprising a worm wheel bearing fixed to said differential toothed wheel receiver, a worm wheel fastened to said worm wheel bearing, and a worm shaft engaging said worm wheel.

9. The apparatus as set forth in claim 1, wherein:

said differential means comprises a worm shaft.

10. The apparatus as set forth in claim 9, wherein said differential means further comprises:

a worm wheel driven by said worm shaft;

a worm wheel bearing fastened to said worm wheel; and a differential toothed wheel receiver fixed to said worm wheel bearing, said differential toothed wheel receiver engaging said drive means to vary said phase of said sun gear means upon rotation of said worm wheel by said worm shaft.

11. The apparatus as set forth in claim 9, and further comprising:

a worm driving shaft having a handle thereon, said worm driving shaft engaged with said worm shaft such that rotation of said handle turns said worm shaft.

* * * * *